United States Patent [19]

Topliffe

[11] 4,332,360

[45] Jun. 1, 1982

[54] AUTOMATICALLY DEPLOYED SHELL FINS

[75] Inventor: Roger O. Topliffe, Amherst, N.H.

[73] Assignee: The United States of America as represented by the Secretary of the Army, Washington, D.C.

[21] Appl. No.: 170,341

[22] Filed: Jul. 21, 1980

[51] Int. Cl.[3] ..... F42B 13/32

[52] U.S. Cl. ..... 244/3.27

[58] Field of Search ..... 244/3.27–3.3

[56] References Cited

U.S. PATENT DOCUMENTS 2,821,924 2/1958 Hansen et al. ..... 244/3.28

3,289,587 12/1966 Donnelly et al. ..... 244/3.28

3,944,168 3/1976 Bizien et al. ..... 244/3.28

FOREIGN PATENT DOCUMENTS

B 27971 9/1956 Fed. Rep. of Germany ..... 244/3.28

*Primary Examiner*—Harold J. Tudor

*Attorney, Agent, or Firm*—Nathan Edelberg; Robert P. Gibson; Max Yarmovsky

[57] ABSTRACT

A guided artillery shell is provided with a set of tail fins which are stowed within the shell assembly prior to the firing of the shell and during barrel traversal, and are automatically deployed upon muzzle exit by a mechanism responsive to the change in pressure upon muzzle exit and centrifugal force.

5 Claims, 2 Drawing Figures

AUTOMATICALLY DEPLOYED SHELL FINS

GOVERNMENT INTEREST

The invention described herein was made in the course of a contract with the Government and may be manufactured, used and licensed by or for the Government for governmental purposes without the payment to me of any royalty thereon.

BACKGROUND OF THE INVENTION

The field of this invention is guided, spin stabilized ballistic missiles or shells. It has been found that by providing terminal guidance to conventional artillery shells in the 155 mm to 8 inch range, the accuracy can be significantly improved. For example, the effects of imprecise meteorological data, muzzle velocity variations and target movement can be corrected with a target seeking guidance system. Such shells comprise canard surfaces for steering control, an electronic target acquisition and guidance system, and a set of tail fins for lift augmentation. The tail fins however must be retracted for storage and handling and while the shell is traversing the barrel, and must be deployed just after muzzle exit. The present invention provides an artillery shell of the type described with a set of tail fins which are retracted at all times prior to muzzle exit and which are automatically deployed or extended immediately after the round leaves the muzzle, through the combined action of the change in pressure experienced upon muzzle exit and the centrifugal force on the retracted fins due to shell spin. The mechanism provides a simple, reliable and inexpensive means for automatically deploying the fins.

SUMMARY OF THE INVENTION

An open framework is attached to or made integral with the aft or rear end of the shell. The generally cylindrical framework, called a fin support frame, comprises a plurality of large pressure equalizing ports in its aft end, with an equal plurality of fin slots equally spaced around its periphery, one slot being provided for each fin. The frame further comprises a central rod extending from the center of its aft end to the center of the aft end of the projectile or shell. A piston comprising a central hole just slightly larger than said central rod and with a pressure chamber surrounding said central hole is mounted within the frame on said central rod. Prior to muzzle exit, the piston is held against the inside rear surface of the frame by means of a shear pin, with the aft end of the frame forming one wall of the pressure chamber, but with one or more small pressure control holes in the frame arranged to allow relatively slow gas flow in and out of the piston pressure chamber. The fins are held in the stowed or retracted position by a latch on the outside of the piston. Upon firing, the gun chamber pressure quickly pressurizes the inside of the frame. The inside or pressure chamber of the piston is however pressurized at a slower rate since the gases must enter it through the aforementioned small pressure control holes. The fins in the retracted position are mounted so that the centrifugal force resulting from shell spin-up caused by the barrel rifling will urge them to the deployed or extended position, however the aforementioned latching means will hold them retracted prior to muzzle exit. Upon muzzle exit the pressure inside the fin support frame will rapidly drop to ambient or atmospheric due to the large and numerous pressure equalizing ports therein, while the pressure inside the piston chamber will, momentarily at least, remain high, since it is connected to the atmosphere only by the small pressure control holes. The resulting pressure differential urges the piston forward, breaking the shear pin and unlatching the fins which are then free to deploy, impelled by centrifugal force.

Thus it is an object of this invention to provide a simple, reliable and inexpensive mechanism whereby a guided artillery shell may be fitted with tail fins which are retracted during firing and prior thereto, and which are automatically deployed just after muzzle exit by means operated by propellant gases and the shell's rotation.

This and other objects and advantages of the invention will become apparent from the following detailed description and drawings.

DETAILED DESCRIPTION OF A PREFERRED EMBODIMENT

Figure 2:
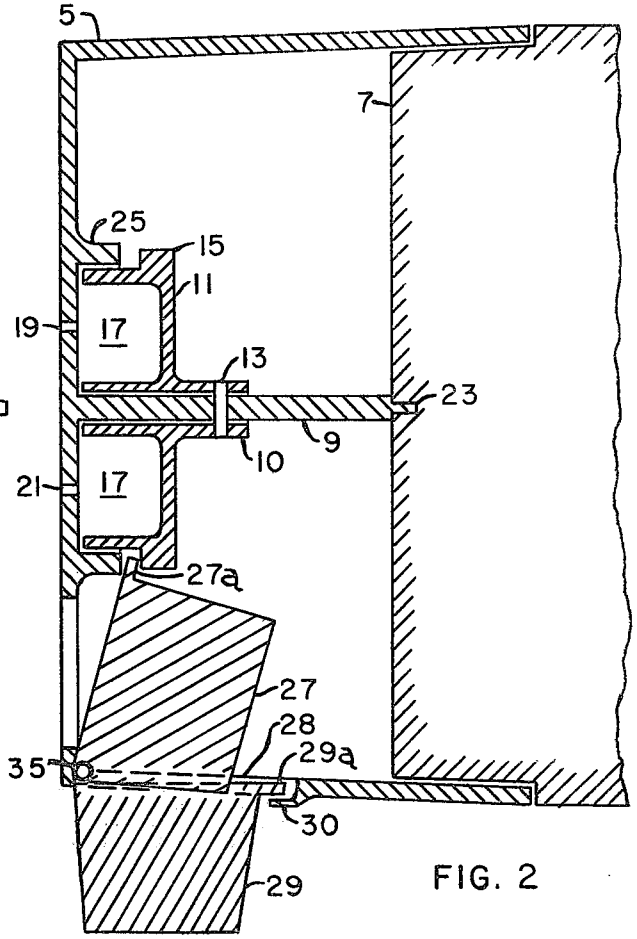
FIG. 2 is a section of FIG. 1 along lines 2—2, showing the details of the novel mechanism and how it is attached to the shell.
Figure 1:
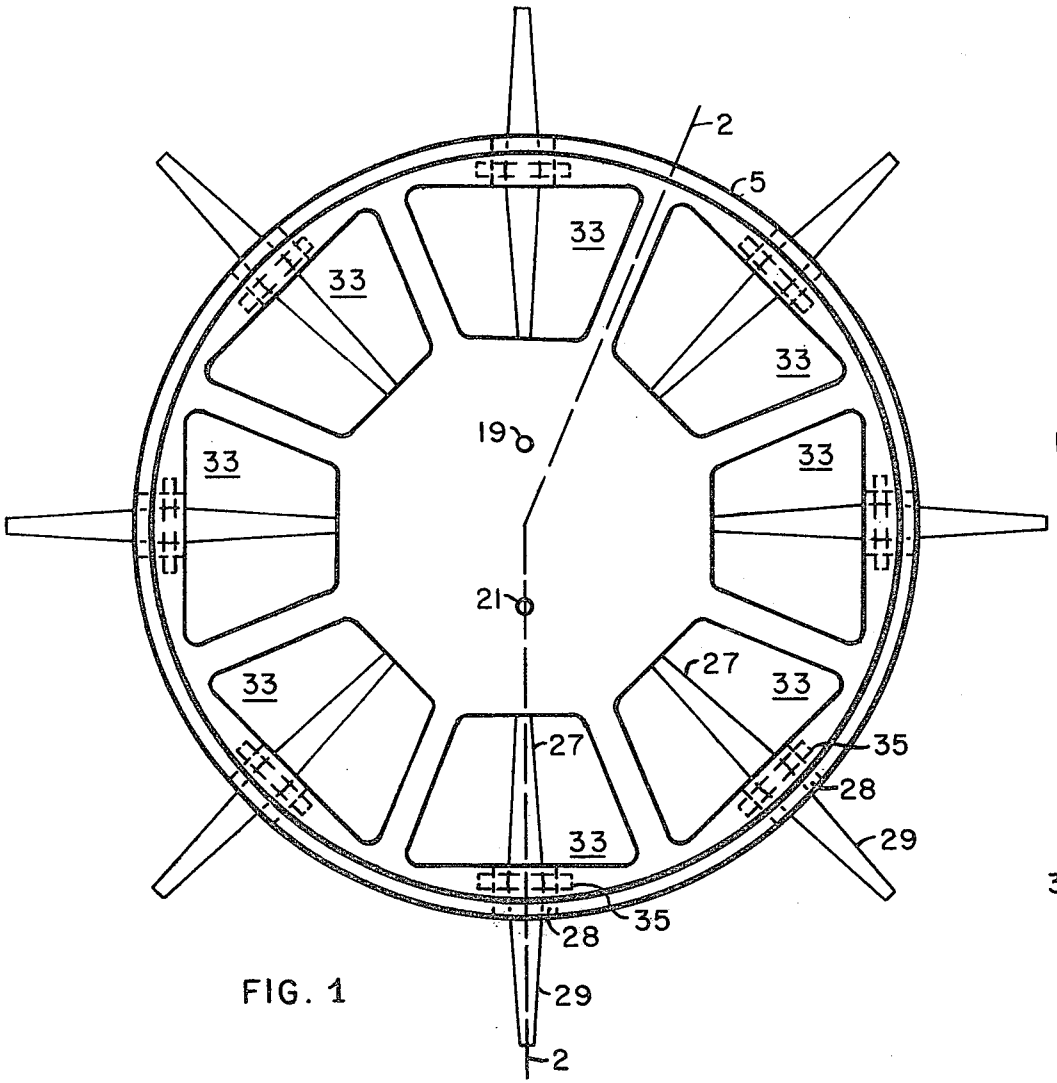
FIG. 1 is a view of the aft end of the fin support frame.

In FIGS. 1 and 2 the fin support frame 5 is generally cylindrical and is attached by suitable means to the aft end of shell 7. In the illustrated embodiment, the frame is provided with eight pressure equalizing ports 33, equally spaced around the center of the aft end of frame 5. The shape and number of these ports is unimportant, but in the illustrative embodiment one port is provided for each tail fin. The ports should have an area large enough to prevent any substantial pressure differential between the inside and outside of the frame. In FIG. 1, the ports 33 comprise at least half of the area of the aft end of frame 5, which would be adequate to produce the desired result.

In the drawings, eight tail fins are shown, centrally located forward of each of the pressure equalizing ports. All of the fins are shown in both the retracted or stowed positions 27, and in the deployed or extended positions 29. The fins are pivotally mounted on pins 35 which are journaled near the periphery of the aft end of the frame 5, as shown. Thus the fins are pivoted around one edge of their inboard ends. The opposite edge of the inboard end of each fin includes a projection 27*a*, which, in the stowed position engages a projection or flange 15 on the periphery of piston 11, to hold the fins retracted.

The inside of the aft end of the frame includes a circular rim or projection 25 which is designed to receive the piston 11. Piston 11 has a generally cylindrical exterior with a rim or flange 15 at the forward end thereof adapted to engage the projections 27*a* on the retracted fins to form a latching means. The central rod 9 of the frame 5 is anchored to the shell body 7 by means of pin 23. The piston has a central hole just larger than rod 9 and it is adapted to slide along rod 9. A shear pin 13 passes through the shoulder 10 in the piston to hold the piston in the position shown prior to muzzle exit. The pressure chamber 17 inside the piston is formed by a recess in the piston and the inside of the aft end of frame 5. A pair of small pressure control holes 19 and 21 in the aft end of frame 5 provide communication to the pressure chamber. As stated above, the holes are intended to permit the chamber 17 to be relatively slowly pressurized by gun chamber gas during firing, and to retain this pressure for a short time after muzzle exit, thus they must have an area substantially less than that of the pressure equalizing ports. In order to achieve this end, these holes should be no more than 2 mm in diameter, when utilized with shells of the aforementioned size.

In the stowed position the center of gravity of the fins 27 is forward of the pivot pin 35, so that the centrifugal force caused by shell rotation will tend to pivot the fins outward to the deployed position 29. The frame is provided with eight fin slots 28 through which the fins move as they are deployed. The forward edge of these slots, 30, forms a stop for the deployed projection 29*a* of each fin, so that further outward movement of the fins is inhibited.

In operation, the fins are held in the stowed position by the projections 27*a* on each fin and flange 15 on piston 11. Upon firing of the shell the area all around and inside frame 5 will be subjected to extremely high gun chamber pressures and the barrel rifling will spin the shell. The fins will be urged toward deployment but they will be restrained by the aforementioned latching means. During barrel traversal, the gun chamber gas pressure will gradually pressurize chamber 17 through holes 19 and 21. Upon muzzle exit, the pressure around and inside of frame 5 will rapidly drop to atmospheric because of the large pressure equalizing ports 33, however because of the small holes 19 and 21, the piston chamber 17 will lose its pressure to the atmosphere at a much slower rate than does the inside of the frame. This differential pressure is enough to fracture shear pin 13 and to propel the piston 11 forward, thus unlatching all of the fins and permitting them to deploy due to centrifugal force. The same centrifugal force will then hold the fins in the deployed position up against stops 30.

In a variation of this embodiment, not illustrated, the fins may be mounted on tracks within the frame 5, with radial tracks being provided to engage the forward and aft edges of each fin so that upon the unlatching of the fins by the piston movement, the fins slide radially outward on the tracks to the deployed position.

While the invention has been described in relation to preferred embodiments, variations therein will be obvious to those skilled in the art. Accordingly, the invention should be limited only by the scope of the appended claims.

I claim:

1. A guided artillery shell having automatically deployed tail fins, comprising, a generally cylindrical fin support frame attached to the aft end of said shell's body, said frame having a plurality of large, equally spaced pressure equalizing ports in its aft end and an equal plurality of fin slots equally spaced around the periphery of said frame, said frame further comprising a central rod extending from the center of its aft end to the center of the aft end of said shell's body, a piston with a central hole slidably mounted on said central rod and held, prior to muzzle exit, against said aft end of said frame by means of a shear pin passing through a shoulder on said piston and said central rod, said piston including a pressure chamber formed by a recess therein and the inside of said aft end of said frame, a plurality of small pressure control holes in said aft end of said frame communicating with said pressure chamber, a set of tail fins pivoted near one edge of their inboard ends on pins mounted in said frame, the opposite edge of said inboard ends of said fins having a projection thereon which, prior to muzzle exit, is latched under a flange on the outside of said piston, the fins completely stowed inside said frame prior to launch, whereby upon firing of said shell, the gun chamber gases will pressurize said piston pressure chamber through said pressure control holes and upon muzzle exit the pressure therein will force the piston forward, breaking said shear pin and unlatching said stowed tail fins which will then pivot around said pins to the deployed position, passing through said fin slots, with the projections thereon stopping against the forward edge of said fin slots.

2. The apparatus of claim 1 wherein said pressure equalizing ports comprise at least half of the area of the aft end of said frame, and wherein said pressure control holes are no more than 2 mm in diameter and the number of said pressure control holes is two.

3. Apparatus for providing artillery shells with tail fins which are retracted prior to firing and during barrel traversal, and are automatically deployed upon muzzle exit, comprising, an open cylindrical fin support framework attached to the aft end of a shell body, having a plurality of large pressure equalizing ports in its rear end, a piston mounted within said open fin framework, said piston comprising a pressure chamber, with one or more small pressure control holes disposed in the aft end of said fin support framework thereof, said piston being slidable mounted on a central rod within said open framework so that it may move forward, said piston being constrained prior to muzzle exit to an aft position by means of a shear pin passing through said central rod and said piston, a plurality of tail fins completely stowed and rotatably mounted within said open framework prior to muzzle exit and latched in the stowed position therein by a latching means on the outside of said piston, said fins being mounted so that centrifugal force caused by shell rotation will urge them to the deployed position, whereby upon the firing of said shell and barrel traversal, said pressure chamber will become pressurized by propellant gases and upon muzzle exit the pressure therein will urge said piston forward, fracturing said shear pin and allowing said fins to assume the deployed position under the influence of centrifugal force.

4. The apparatus of claim 3 wherein the size of the holes in said open framework is made much larger than the size of said pair of pressure control holes, whereby the differential pressure between said pressure chamber and the outside of said piston just after muzzle exit will be sufficient to fracture said shear pin and move said piston forward to unlatch said stowed tail fins.

5. The apparatus of claim 3 wherein said pressure control holes are approximately 2 mm in diameter.

* * * * *